US010173300B1

(12) United States Patent
Miess

(10) Patent No.: US 10,173,300 B1
(45) Date of Patent: Jan. 8, 2019

(54) POLYCRYSTALLINE DIAMOND COMPACT, DRILL BIT INCORPORATING SAME, AND METHODS OF MANUFACTURE

(71) Applicant: US Synthetic Corporation, Orem, UT (US)

(72) Inventor: David P. Miess, Highland, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 381 days.

(21) Appl. No.: 14/876,159

(22) Filed: Oct. 6, 2015

Related U.S. Application Data

(60) Provisional application No. 62/060,426, filed on Oct. 6, 2014.

(51) Int. Cl.

| | |
|---|---|
| ***B24D 18/00*** | (2006.01) |
| ***E21B 10/55*** | (2006.01) |
| ***E21B 10/573*** | (2006.01) |
| ***B24D 3/06*** | (2006.01) |

(52) U.S. Cl.
CPC ..... *B24D 18/0009* (2013.01); *B24D 3/06* (2013.01); *E21B 10/55* (2013.01); *E21B 10/573* (2013.01)

(58) Field of Classification Search
CPC ..... B24D 18/0009; B24D 3/06; E21B 10/55; E21B 10/573
See application file for complete search history.

(56) References Cited

U.S. PATENT DOCUMENTS

| | | | | |
|---|---|---|---|---|
| 4,645,977 | A | 2/1987 | Kurokawa et al. | |
| 4,707,384 | A | 11/1987 | Schachner et al. | |
| 5,439,492 | A | 8/1995 | Anthony et al. | |
| 5,967,245 | A * | 10/1999 | Garcia | E21B 10/16 175/374 |
| 7,866,418 | B2 | 1/2011 | Bertagnolli et al. | |
| 7,971,663 | B1 * | 7/2011 | Vail | B01J 3/062 175/428 |
| 8,061,458 | B1 * | 11/2011 | Bertagnolli | B32B 9/00 175/434 |
| 8,079,431 | B1 | 12/2011 | Cooley et al. | |
| 8,202,335 | B2 | 6/2012 | Cooley et al. | |
| 8,236,074 | B1 | 8/2012 | Bertagnolli et al. | |
| 8,297,382 | B2 | 10/2012 | Bertagnolli et al. | |

(Continued)

*Primary Examiner* — Matthew R Buck
*Assistant Examiner* — Aaron L Lembo
(74) *Attorney, Agent, or Firm* — Dorsey & Whitney LLP

(57) ABSTRACT

Methods of making superabrasive elements may include forming a first superabrasive body, forming discrete components from the first superabrasive body, and then forming a second abrasive element from the discrete components. For example, microstructures (e.g., micro-cylinders or other geometries) may be formed from the first superabrasive element, catalyst materials may be removed from the microstructures, with the microstructures being recombined and bonded during a subsequent high-pressure, high-temperature (HPHT) process. In other embodiments, superabrasive elements may be formed to include microfeatures formed in a surface of a superabrasive body or table. For example, blind holes or slots may be formed in a surface of the element for use in attaching the superabrasive table to a substrate. The holes may be coated to provide an impermeable surface, or they may be filled with a metallic material to enhance the attachment to a substrate.

20 Claims, 11 Drawing Sheets

(56) References Cited

U.S. PATENT DOCUMENTS

| | | | | |
|---|---|---|---|---|
| 8,439,137 | B1 * | 5/2013 | Galloway | E21B 10/573 175/432 |
| 8,789,627 | B1 | 7/2014 | Sani et al. | |
| 8,960,338 | B1 * | 2/2015 | Galloway | E21B 10/573 175/432 |
| 2004/0238227 | A1 * | 12/2004 | Smith | C04B 35/52 175/431 |
| 2010/0276200 | A1 * | 11/2010 | Schwefe | E21B 10/55 175/57 |
| 2017/0057877 | A1 * | 3/2017 | Cooley | C04B 35/528 |

* cited by examiner

POLYCRYSTALLINE DIAMOND COMPACT, DRILL BIT INCORPORATING SAME, AND METHODS OF MANUFACTURE

CROSS-REFERENCE TO RELATED APPLICATIONS

This application claims the benefit of provisional application Ser. No. 62/060,426, filed on Oct. 6, 2014, the disclosure of which is hereby incorporated by reference in its entirety.

BACKGROUND

Polycrystalline diamond compacts (PDCs) have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly to a bit body, such as in a pocket formed on a blade or other feature of the bit body. The substrate of the PDC may be brazed or otherwise joined to an attachment member, such as a cylindrical backing. A rotary drill bit conventionally includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

PDCs are conventionally fabricated by placing a cemented carbide substrate into a container with a volume of diamond particles positioned on a surface of the cemented carbide substrate. The container may be loaded into an HPHT press with the substrate and volume of diamond particles then being processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in formation of a matrix of bonded diamond grains having diamond-to-diamond bonding therebetween. Interstitial regions between the bonded diamond grains are consequently occupied by the metal-solvent catalyst.

The presence of the metal-solvent catalyst in the PCD table is believed to reduce the thermal stability of the PCD table at elevated temperatures experienced during drilling of a subterranean rock formation. For example, the difference in thermal expansion coefficient between the diamond grains and the metal-solvent catalyst is believed to lead to chipping or cracking of the PCD table during drilling or cutting operations, which consequently can degrade the mechanical properties of the PCD table or cause failure. Additionally, some of the diamond grains can undergo a chemical breakdown or back-conversion to graphite via interaction with the metal-solvent catalyst.

One conventional approach for improving the thermal stability of PDCs is to at least partially remove the metal-solvent catalyst from the PCD table of the PDC by acid leaching. Despite the availability of a number of different PDCs, manufacturers and users of PDCs continue to seek improved thermally stable PDCs.

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

For example, rotary drill bits employing polycrystalline diamond compact ("PDC") cutters are often employed for drilling subterranean formations. Conventional drill bit bodies may be formed of steel or may comprise a so-called tungsten carbide matrix including tungsten carbide particles distributed within a binder material.

Tungsten carbide matrix drill bit bodies may be fabricated by preparing a mold that embodies the inverse of the desired generally radially extending blades, cutting element sockets or pockets, junk slots, internal watercourses and passages for delivery of drilling fluid to the bit face, ridges, lands, and other external topographic features of the drill bit. Particulate tungsten carbide may then be placed into the mold and a binder material, such as a metal including copper and tin, may be melted into the tungsten carbide particulate and solidified to form the drill bit body. Steel drill bit bodies may be fabricated by machining a piece of steel to form generally radially extending blades, cutting element sockets or pockets, junk slots, internal watercourses and passages for delivery of drilling fluid to the bit face, ridges, lands, and other external topographic features of the drill bit.

In both matrix-type and steel bodied drill bits, a threaded pin connection may be formed for securing the drill bit body to the drive shaft of a downhole motor or directly to drill collars at the distal end of a drill string rotated at the surface by a rotary table, top drive, drilling motor or turbine.

SUMMARY

The present invention relates generally to superabrasive elements, methods of manufacturing superabrasive elements, and apparatuses incorporating superabrasive elements. In accordance with one embodiment of the present invention, a method of forming a superabrasive element is provided. The method includes forming a first superabrasive body in a high-pressure, high-temperature (HPHT) process, forming a plurality of discrete structures from the superabrasive body and forming a second superabrasive body from at least some of the plurality of discrete structures in an HPHT process.

In accordance with one embodiment, forming a first superabrasive body may include forming a polycrystalline table.

In accordance with one embodiment, forming a plurality of discrete structures includes forming a plurality of micro structures. Forming a plurality of micro-structures may include forming at least one of a cylinder, a sphere, a polyhedron, a disc and a platelet.

In accordance with one embodiment, the method may further include forming the plurality of micro structures by an electric discharge machining (EDM) process. For example, the EDM process may include a micro-EDM process.

In accordance with one embodiment, forming a plurality of discrete structures includes forming at least one ring structure.

In accordance with one embodiment, forming the first superabrasive body includes flowing a catalyst material through a plurality of diamond grains during the HPHT process, and removing catalyst material from interstitial spaces between bonded diamond grains subsequent the HPHT process.

In accordance with one embodiment, the method may further include forming a material coating on the at least some of the plurality of discrete structures subsequent to removing catalyst material and prior to forming the second superabrasive body.

In accordance with one embodiment, the method further includes maintaining the at least some of the plurality of discrete structures free of catalyst material during the HPHT process associated with forming the second superabrasive body.

In accordance with one embodiment, the method further comprises attaching the second superabrasive body to a substrate. In one embodiment, the second superabrasive body is attached to a substrate subsequent forming the second superabrasive body. In accordance with another embodiment, the second superabrasive body is attached to a substrate substantially simultaneously as the act of forming the second superabrasive body.

In accordance with one embodiment, the method includes forming a plurality of micro-features in a surface of the second superabrasive body that is to be bonded to the substrate. In one embodiment, forming a plurality of micro-features includes forming a plurality of blind holes. In accordance with one embodiment, material is disposed in the plurality of blind holes prior to attaching the superabrasive body to the substrate.

In accordance with another embodiment of the present invention, another method of forming a superabrasive element is provided. The method includes forming a superabrasive body, forming a plurality of discrete micro-features in a first surface of the superabrasive body, and attaching the superabrasive body to a substrate including bonding the first surface of the superabrasive body to a surface of the substrate.

In accordance with one embodiment, the method further includes forming each of the plurality of discrete micro-features to include a blind hole having an opening at the first surface of the superabrasive body, a sidewall and a floor.

In accordance with one embodiment, the method includes forming each blind hole such that the sidewall is tapered such that the opening exhibits a smaller area than does the floor.

In accordance with one embodiment, the method further includes disposing a metal material in each blind hole prior to attaching the superabrasive body to the substrate.

In accordance with one embodiment, the act of attaching the superabrasive body to the substrate includes at least one of brazing, fusing and welding.

In accordance with one embodiment, the method includes forming each opening to comprise at least one of a substantially circular opening, a linear slot or an arcuate slot.

In accordance with one embodiment, forming a superabrasive body includes flowing a catalyst material through diamond material during a high-temperature, high-pressure (HPHT) process, and the method further includes removing catalyst material from interstitial spaces of bonded diamond grains in the superabrasive body subsequent the HPHT process and prior to attaching the superabrasive body to the substrate.

In accordance with one embodiment, the method further includes forming a material coating in each blind hole prior to attaching the superabrasive body to the substrate.

In accordance with another embodiment of the invention, a superabrasive element is provided. The superabrasive element includes a superabrasive body comprising a plurality of pre-formed, superabrasive microstructures, the microstructures being bonded to one another through a high-pressure, high-temperature (HPHT) process.

In accordance with one embodiment, a plurality of interstitial spaces are located between the plurality of bonded microstructures and include a catalyst material disposed therein. Additionally a plurality of interstitial spaces are located within each of the microstructures and are substantially devoid of any catalyst material.

In accordance with one embodiment, each of the plurality of microstructures have a material coating thereon.

In accordance with one embodiment, the superabrasive element further comprises a plurality of diamond grains intermixed with and bonded to the plurality of plurality of microstructures.

In accordance with one embodiment, the plurality of microstructures comprise at least one of a cylinder, a sphere, a polyhedron, a disc and a platelet.

In accordance with another embodiment of the present invention another superabrasive element is provided. The superabrasive element includes body bonded to a preformed, superabrasive ring, wherein the superabrasive body includes a plurality of interstitial spaces having a catalyst material disposed therein, and wherein the superabrasive ring includes a plurality of interstitial spaces being substantially devoid of any catalyst material.

In accordance with one embodiment, a surface of the superabrasive body is substantially coplanar with a surface of the superabrasive ring.

In accordance with one embodiment, the superabrasive body comprises polycrystalline diamond, and wherein the preformed superabrasive ring comprises polycrystalline diamond.

In accordance with one embodiment, the superabrasive element includes a material coating on the superabrasive ring.

In accordance with one embodiment of the present invention, another superabrasive element is provided. The superabrasive element includes a superabrasive body having a plurality of microfeatures formed in a surface thereof, the microfeatures comprising blind holes.

In accordance with one embodiment, the blind holes include an opening, a sidewall and a floor, and wherein the sidewall is tapered such that the opening exhibits a smaller area than does the floor.

In accordance with one embodiment, the superabrasive element further comprises a material coating disposed over the floor and sidewall of the blind holes.

In accordance with one embodiment, the superabrasive element further comprises a metal filler material disposed in the blind holes.

In accordance with one embodiment, the superabrasive element further comprises a substrate attached to the superabrasive body along the surface in which the blind holes are formed.

In accordance with one embodiment, a rotary drill bit is provided. The rotary drill bit includes a shank, a bit body attached to the shank and at least one cutting element coupled with the bit body. The cutting element may comprise any superabrasive elements described herein.

Features from any of the various embodiments described herein may be used in combination with one another, without limitation. In addition, other features and advantages of the instant disclosure will become apparent to those of ordinary skill in the art through consideration of the ensuing description, the accompanying drawings, and the appended claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1A:
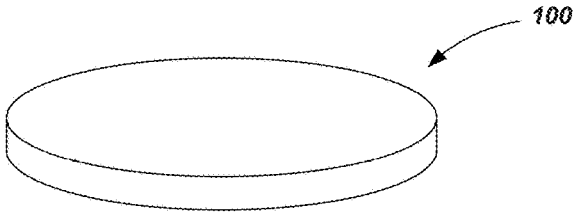
FIGS. 1A-1D are perspective views of a superabrasive table at various stages of manufacture.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present invention relates generally to drill bits, such as rotary drill bits used for drilling subterranean formations. "Superhard," as used herein, refers to any material having a hardness that is at least equal to a hardness of tungsten carbide. Additionally, a "superabrasive material," as used herein, may refer to a material exhibiting a hardness exceeding a hardness of tungsten carbide, such as, for example, polycrystalline diamond. In addition, as used throughout the specification and claims, the word "cutting" generally refers to any drilling, boring, or the like. The word "cutting," as used herein, refers broadly to machining processes, drilling processes, or any other material removal process utilizing a cutting element.

FIG. 1A shows a superabrasive body or element 100 which, in one embodiment, may include disc or a table of sintered polycrystalline diamond (PCD) material. Some non-limiting examples of superabrasive elements are described in U.S. Pat. No. 8,297,382 to Bertagnolli et al., issued Oct. 30, 2012, U.S. Pat. No. 8,079,431 to Cooley et al., issued Dec. 20, 2011, and U.S. Pat. No. 7,866,418 to Bertagnolli et al., issued Jan. 11, 2011, the disclosures of which are incorporated by reference herein in their entireties. It is noted that the '418 Patent to Bertagnolli describes PCD materials that may exhibit a specified magnetic saturation, a specified level of coercivity, or both. In one example, the PCD material may exhibit a coercivity of about 115 Oersteds (Oe) or more. In another example, the PCD material may exhibit a specific magnetic saturation of about 15 Gauss·cm$^3$/grams or less. In various embodiments, the microstructures described herein, and/or the PCD matrix materials containing such microstructures, may be formed to exhibit such magnetic characteristics in accordance with the description of the '418 Bertagnolli Patent.

In one embodiment the superabrasive element 100 may be formed by subjecting diamond particles in the presence of a catalyst to HPHT (high-pressure, high-temperature) sintering conditions. The catalyst may be, for example, in the form of a powder, a disc or foil. In the embodiment shown in FIG. 1A, the superabrasive element 100 does not include a substrate. In other embodiments described below, other superabrasive elements may be attached to or formed with a substrate. In some embodiments, when the superabrasive elements are formed with a substrate, the substrate may act as a source of the catalyst material (e.g., with the substrate comprising a cemented carbide material).

For example, when formed a PCD body or table, the superabrasive element 100 may be fabricated by subjecting a plurality of diamond particles 104 (e.g., diamond particles having an average particle size between 0.5 μm to about 150 μm) to a HPHT sintering process in the presence of a catalyst, such as a metal-solvent catalyst, cobalt, nickel, iron, a carbonate catalyst, an alloy of any of the preceding metals, or combinations of the preceding catalysts to facilitate intergrowth between the diamond particles and form the PCD table comprising directly bonded-together diamond grains (e.g., exhibiting sp$^3$ bonding) defining interstitial regions with the catalyst disposed within at least a portion of the interstitial regions. In order to effectively HPHT sinter the plurality of diamond particles, the particles and catalyst material may be placed in a pressure transmitting medium, such as a refractory metal can, graphite structure, pyrophyllite or other pressure transmitting structure, or another suitable container or supporting element. The pressure transmitting medium, including the particles and catalyst material, may be subjected to an HPHT process using an HPHT press at a temperature of at least about 1000° C. (e.g., about 1300° C. to about 1600° C.) and a cell pressure of at least 4 GPa (e.g., about 5 GPa to about 10 GPa, or about 7 GPa to about 9 GPa) for a time sufficient to sinter the diamond particles and form a PCD table.

In certain embodiments, as discussed below, a superabrasive element may be formed such that it is bonded to a substrate. In such an embodiment, the superabrasive element is formed by sintering the diamond (or other superabrasive) particles in the presence of the substrate in a first HPHT process, the substrate may include cobalt-cemented tungsten carbide from which cobalt or a cobalt alloy infiltrates into the diamond particles and catalyzes formation of PCD. For example, the substrate may comprise a cemented carbide material, such as a cobalt-cemented tungsten carbide material or another suitable material. Nickel, iron, and alloys thereof are other catalysts that may form part of the substrate. The substrate may include, without limitation, cemented carbides including titanium carbide, niobium carbide, tantalum carbide, vanadium carbide, and combinations of any of the preceding carbides cemented with iron, nickel, cobalt, or alloys thereof.

As previously noted, in other embodiments, instead of, or in addition to, relying on the substrate to provide a catalyst material during the HPHT process, a catalyst material disc may be placed adjacent to the diamond particles and/or catalyst particles may be mixed with the diamond particles. In some embodiments, the catalyst may be a carbonate catalyst selected from one or more alkali metal carbonates (e.g., one or more carbonates of Li, Na, and K), one or more alkaline earth metal carbonates (e.g., one or more carbonates of Be, Mg, Ca, Sr, and Ba), or combinations of the foregoing. The carbonate catalyst may be partially or substantially completely converted to a corresponding oxide of Li, Na, K, Be, Mg, Ca, Sr, Ba, or combinations of the foregoing oxides after HPHT sintering of the plurality of diamond particles. The diamond particle size distribution of the plurality of diamond particles may exhibit a single mode, or may be a bimodal or greater distribution of grain size. In one embodiment, the diamond particles may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger average particle size (e.g., 50 μm, 40 μm, 30 μm, 20 μm, 15 μm, 12 μm, 10 μm, 8 μm) and another portion exhibiting at least one relatively smaller average particle size (e.g., 6 μm, 5 μm, 4 μm, 3 μm, 2 μm, 1 μm, 0.5 μm, less than 0.5 μm, 0.1 μm, less than 0.1 μm). In one embodiment, the diamond particles may include a portion exhibiting a relatively larger average particle size between about 10 μm and about 40 μm and another portion exhibiting a relatively smaller average particle size between about 1 μm and 4 μm. In some embodiments, the diamond particles may comprise three or more different average particle sizes (e.g., one relatively larger average particle size and two or more relatively smaller average particle sizes), without limitation.

When sintered using a catalyst material, the catalyst material may remain in interstitial spaces between the bonded diamond grains. In various embodiments, at least some of the catalyst material may be removed from the interstitial spaces of the superabrasive element 100. For example, catalyst material may be removed (such as by acid-leaching) to any desired depth from a defined surface of the superabrasive element. Removal of the catalyst material to provide a substantially catalyst free region (or at least a catalyst-lean region) provides a table that is thermally stable by removing the catalyst material, which exhibits a substantially different coefficient of thermal expansion than the diamond material, in a region or the table expected to see substantial temperature increases during use.

In one embodiment, as discussed below, catalyst material may be removed from the interstitial areas through the entire body of the superabrasive element, making the entire superabrasive element substantially catalyst free among its interstitial areas or spaces.

The interstitial spaces of the catalyst-free region may remain substantially material free or, in some embodiments, a second material (e.g., a material that is different from the catalyst material) may be introduced into the interstitial spaces from which catalyst material has been removed. Some examples of materials that may subsequently introduced into such interstitial spaces, and methods of introducing such materials into the interstitial spaces, are set forth in U.S. Pat. No. 8,061,458 to Bertagnolli et al., issued Nov. 22, 2011, and U.S. Pat. No. 8,236,074 to Bertagnolli et al., issued Aug. 7, 2012, the disclosures of which are incorporated by reference herein in the entireties.

With continued reference to FIG. 1A, the superabrasive element 100 may be configured as a PDC having no substrate. In one embodiment, the entire superabrasive element 100 may substantially devoid of catalyst material. In other words, catalyst material may be removed of the interstitial regions between bonded diamond grains throughout the body of the superabrasive element 100.

Figure 1B:
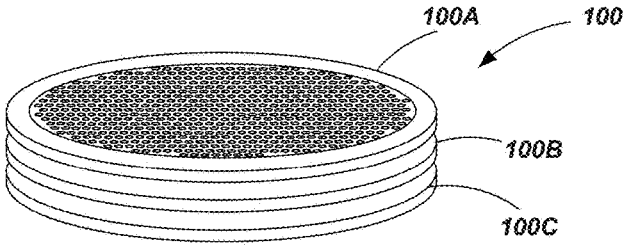

As indicated in FIG. 1B, in accordance with an embodiment of the invention, the superabrasive element 100 may then be formed into a plurality of discrete components. For example, depending on the size of the original superabrasive element 100, it may be cut into multiple sub-elements (e.g., multiple sheets or wafers 100A, 100B, 100C). Each sheet or wafer 100A, 100B and 100C may additionally be cut or formed into additional components including, for example, one or more hoops or rings 102 and one or more discrete micro-components 104 of a specified size and shape. The micro-components 104 may include, for example, cylinders (such as shown), spheres, granules, cuboids or other polyhedrons, bars, platelets (including squares, rectangles or other, generally flat, polygonal geometries), or a variety of other geometrical configurations. In other embodiments, the discrete micro-components may include complex geometries including, for example, helical structures.

Figure 1C:
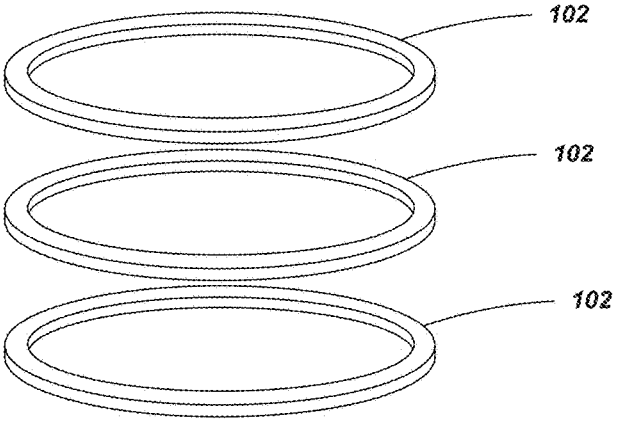
Figure 1D:
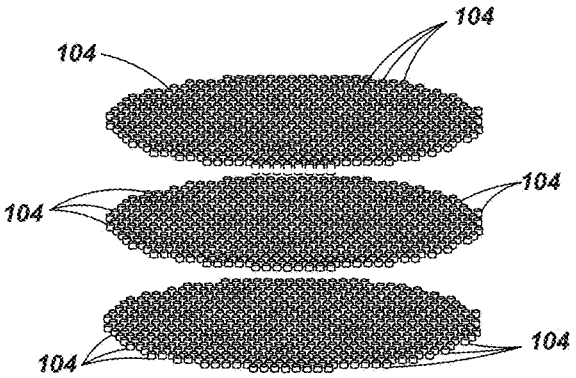

Thus, for example, as seen in FIG. 1C, a plurality of hoops or rings 102 may be formed from a superabrasive element 100, as well as a plurality of micro-components 104 (e.g., micro-cylinders) as shown in FIG. 1D. It is noted that, while FIG. 1C shows rings 102 and FIG. 1D depicts micro-components 104 being formed from each of the three sheets or wafers 100A, 100B, and 100C, in other embodiments, micro-components may be formed exhibiting different sizes, including larger size micro-components being formed directly from the original superabrasive element 100.

The various discrete components (e.g., rings 102 and micro-components 104) may be formed using, for example, electric discharge machining (EDM). Micro EDM processes and machines are available, for example, from Viteris Technologies, a company having a place of business in Salt Lake City, Utah, that enable work pieces (e.g., micro-components formed from the superabrasive element 100) to be formed having features at least as small as 10 microns (0.0004 inch). Additionally, these EDM processes enable the manufacture of micro-components having very high aspect ratios of up to 40:1. Such micro-EDM processes may include wire-EDM, sinker-EDM and milling-EDM processes.

Some non-limiting examples of micro-components include: quadrilateral micro-plates having a thickness of approximately 10 microns (μm) with each of the four sides exhibiting lengths of approximately 40 μm to approximately 1,000 μm; micro-cubes having sides that are approximately 40 μm to approximately 1,000 μm; micro-dowels (which may be considered to be micro-cylinders having a high length-to-diameter ratio) having a diameter of approximately 10 μm to approximately 20 μm and a length of approximately 40 μm to approximately 1,000 μm; platelets or micro-cylinders having a diameter of approximately 40 μm to approximately 1,000 μm and a length or thickness or approximately 10 μm to approximately 20 μm; and micro-discs having a diameter of approximately 8 millimeters (mm) to approximately 19 mm and a height or thickness of approximately 40 μm to approximately 1,000 μm. Of course micro-components of other sizes and shapes are also contemplated and the forgoing are merely set forth as examples. It is noted that in some cases, the micro-components may experience some level of fragmenting or crushing during subsequent HPHT processes, but should retain a recognizable form of the original shape and aspect ratio.

Figure 2:
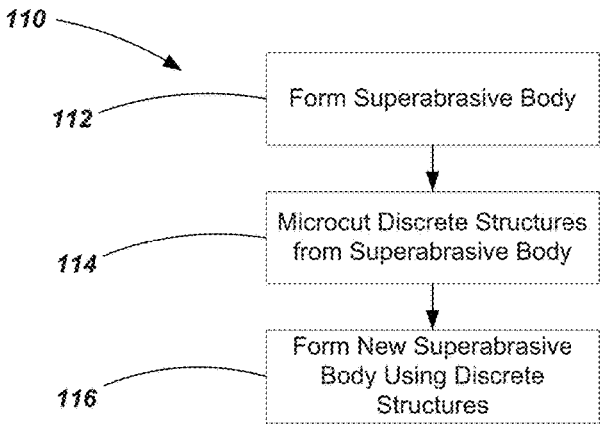
FIG. 2 is a flow chart showing a method of manufacture according to an embodiment of the invention.
Figure 3A:
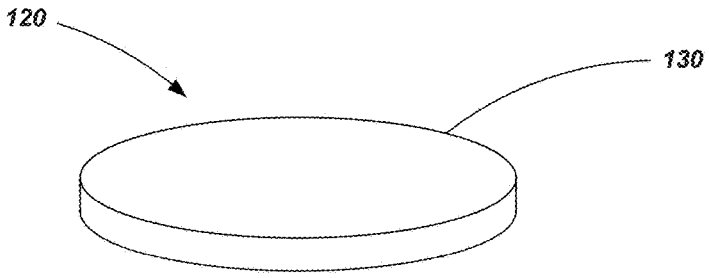
FIGS. 3A and 3B are perspective views of superabrasive elements in accordance with an embodiment of the present invention.
Figure 3B:
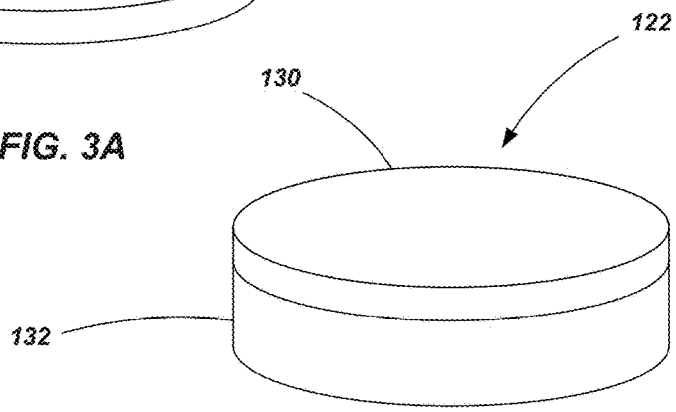

The discrete components 102 and 104 formed from the (first) superabrasive element 100 may be used to form a new (second) superabrasive element, such as a cutting element or a bearing element. For example, as shown in FIG. 2, a method 110 is provided herein that includes forming a superabrasive body or table, as indicated at 112, forming discrete components (e.g., micro-cutting discrete structures) from the superabrasive body, as indicated at 114, and forming a new superabrasive body or table using the preformed, discrete structures as indicated at 116. In one example, a plurality of discrete micro-components 104 (FIG. 1D) may be combined and subjected to a HPHT process to produce a new superabrasive element 120. As shown in FIG. 3A, the new superabrasive element 120 may comprise a superabrasive table 130 that is not attached to a substrate. In another embodiment, as shown in FIG. 3B, a superabrasive element 122 may include a superabrasive table 130 that is attached to a substrate 132. The superabrasive table 130 in either embodiment may include the microstructures 104 that have been bonded to each other through the HPHT process. Substantial control over the size and shape of the microstructures may lead to increased predictability in the performance of the superabrasive element 120, 122 including the thermal stability, wear resistance, and/or impact strength of the superabrasive table 130.

In another embodiment, the superabrasive table 130 may be formed from a combination of microstructures and superabrasive particles (e.g., diamond particles) mixed together. For example, a plurality of microstructures 104 may be mixed with a plurality of diamond grains of a desired size to provide a superabrasive table 130 having a desired content of diamond in terms of volume percentage.

Figure 4A:
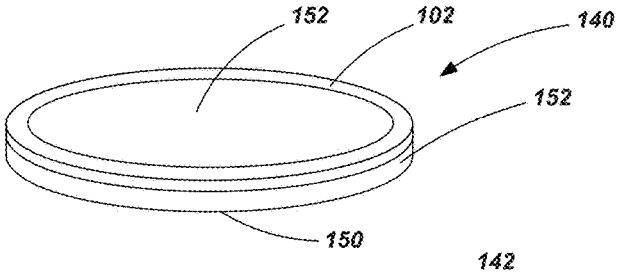
FIGS. 4A and 4B are perspective views of superabrasive elements in accordance with an embodiment of the present invention.
Figure 4B:
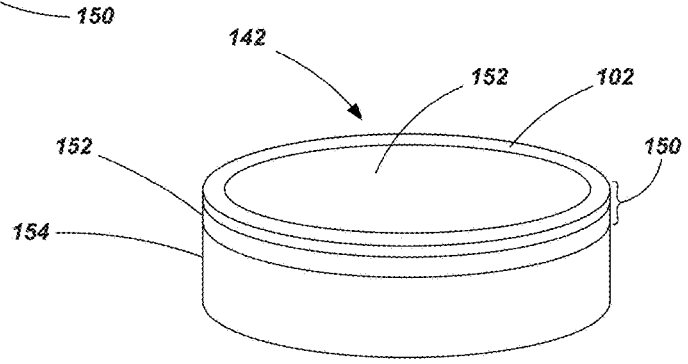

Referring to FIGS. 4A and 4B, additional examples of a superabrasive element are shown that incorporate a hoop or ring 102 that has been micro-cut from a previously formed superabrasive element and which may be substantially free of catalyst materials. For example, the superabrasive element 140 shown in FIG. 4A includes a ring 102 that has been combined with a plurality of superabrasive particles such as diamond particles (or microstructures, or both diamond particles and microstructures) and subjected to a HPHT process. In other embodiments, the ring 102 may be combined with a plurality of microstructures, or with a plurality of microstructures combined with a plurality of superabrasive particles.

The resulting structure includes a superabrasive table 150 that includes the pre-formed (e.g., previously HPHT sintered) ring 102 bonded to a superabrasive body 152 (i.e., the remainder of the superabrasive table 150 not comprising the ring 102) which may be comprised of bonded diamond grains (formed, e.g., from diamond particles and/or preformed microstructures). As shown in FIG. 4B, a superabrasive element 142 may also be formed similar to that described with respect to FIG. 4A, but includes a table 150 that is bonded to a substrate 154. The substrate 154 may be bonded to table 150 during an HPHT process such as described hereinabove.

As previously noted, the preformed ring 102 may already be substantially devoid of catalyst material and may remain so even though subjected to the HPHT process associated with forming the superabrasive element 140 and 142. When the resulting superabrasive element (140 or 142) is used as a cutting element, the outer periphery defined by the ring 102 provides a thermally stable region for engagement with a subterranean formation during drilling operations. If desired, catalyst material may remain in the body 152 of the superabrasive table 150 such that the superabrasive element 140, 142 need not be subjected to further catalyst removal processes. However, in other embodiments, the superabrasive element 140, 142 may be subjected to catalyst removal process to remove catalyst material from the body 152 to a desired depth or from selected regions.

In any of the embodiments exemplified in FIG. 3A, 3B, 4A or 4B, the superabrasive elements may be formed using a HPHT process such as described above, including the introduction of a infiltrant material (whether by way of the substrate or otherwise) to effect bonding between preformed microstructures, micro-cut elements, and other superabrasive materials (e.g., diamond particles). Such an infiltrant material may include, for example, cobalt, nickel, iron, or alloys thereof. Additionally, once formed, the superabrasive elements (120, 122, 140 and 142) may have infiltrant material removed from interstitial areas between bonded structures (e.g., bonded preformed micro-structures or between bonded diamond grains and a ring or other structure) to a desired depth from a working surface such as by acid leaching or some other appropriate process.

Further, in any of the embodiments exemplified in FIG. 3A, 3B, 4A or 4B, the superabrasive elements may be formed in conjunction with a HPHT process such as described in U.S. Pat. No. 8,789,627 to Sani et al., issued on Jul. 29, 2014, the disclosure of which is incorporated by reference herein in its entirety. More specifically, any or all of the microstructures, the ring, or the PCD matrix materials carrying or bonded to the microstructures or ring may be formed in accordance with the techniques described by the Sani '627 Patent.

Figure 5:
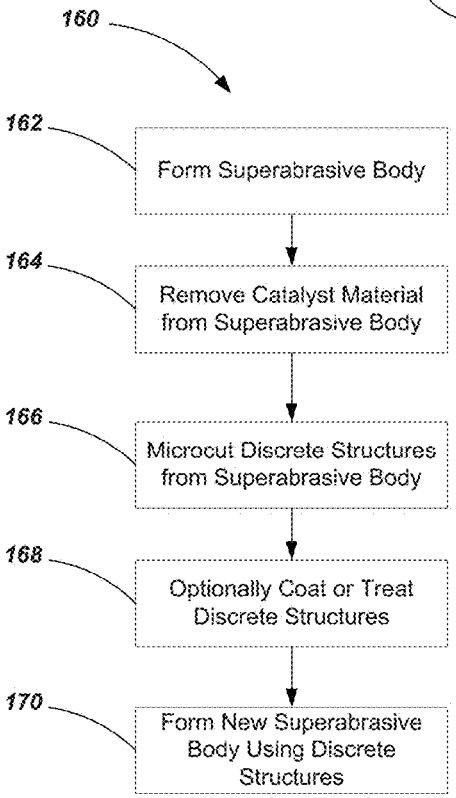
FIG. 5 is a flow chart showing a method of manufacture according to an embodiment of the invention.

In accordance with another embodiment of the invention, another method 160 is provided for forming a superabrasive element as depicted in FIG. 5. The method 160 includes forming a superabrasive body or table as indicated at 162. This may include subjecting a plurality of diamond or superabrasive particles to an HPHT process such as described herein above. Catalyst material is them removed from the superabrasive body as indicated at 164. The catalyst material may be removed, for example, by acid leaching the superabrasive body to remove the catalyst material from the interstitial spaces between diamond grains. In one embodiment, the superabrasive body, now substantially devoid of catalyst material, may be micro-cut into discrete structures as indicated at 166. Such structures may include, for example, rings, wafers, platelets, or microstructures of a desired size and geometry. In other embodiments, the microstructures may be formed prior to removal of catalyst material. For example, when using EDM technologies to form microstructures, the microstructure may be micro-cut prior to catalyst material being removed (or at least prior to complete removal of catalyst material) since removal of the catalyst material can alter the conductivity of the superabrasive body, impacting the effectiveness of EDM processes.

The discrete structures may optionally be coated with one or more materials as indicated at 168 to provide the structures with substantially impermeable surface. Use of a coating on the structures may help to prevent or at least inhibit reinfiltration of an infiltrant material back into the micro-cut structures (e.g., rings 102 or microstructures 104) during subsequent HPHT processes wherein infiltrant material is utilized. In other words, an infiltrant material may flow between such structures, assisting in the bonding of such structures to each other (or to other superabrasive particles), but the infiltrant material does not re-enter the interstitial spaces within the preformed micro-cut structures from which catalyst material has already been removed. In one example embodiment, the structures may be coated with thin layer of diamond material. Other potential coating include carbides, borides, nitrides, carbonitrides, silicides, oxides, elemental coatings of W, Ti, Ta, Nb, Zr, B, Si, Mo, Co, Ni, Fe, C, and any combination of alloys of such materials. In one embodiment, the coating may include a tungsten carbide layer. Specifically, for example, one example of a commercially available CVD tungsten carbide layer (currently marketed under the trademark HARDIDE®) is currently available from Hardide Layers Inc. of Houston, Tex. Other examples of tungsten carbide layers are described, in U.S. Pat. No. 8,202,335, issued on Jun. 19, 2012, to Cooley et al., the disclosure of which is incorporated by reference herein in its entirety. Coatings may be applied, for example, using chemical vapor deposition (CVD), physical vapor deposition (PVD), thermal spray processes, electroplating, plasma fluid bed coating, high energy milling, or other appropriate processes. Some examples of vapor deposition processes are described in U.S. Pat. Nos. 5,439,492, 4,707,384 and 4,645,977, the disclosures of which are each incorporated by reference herein in their entireties.

The coated structures may then be combined to form a new superabrasive body as indicated at 170. The new superabrasive body or element may be formed using HPHT processes such as described above with the optional inclusion of additional materials such as additional superabrasive particles and infiltrant materials. The new superabrasive body or element may include, for example, the examples shown in FIGS. 3A, 3B, 4A and 4B, or may include a variety of other shapes, sizes and configurations.

Figure 6A:
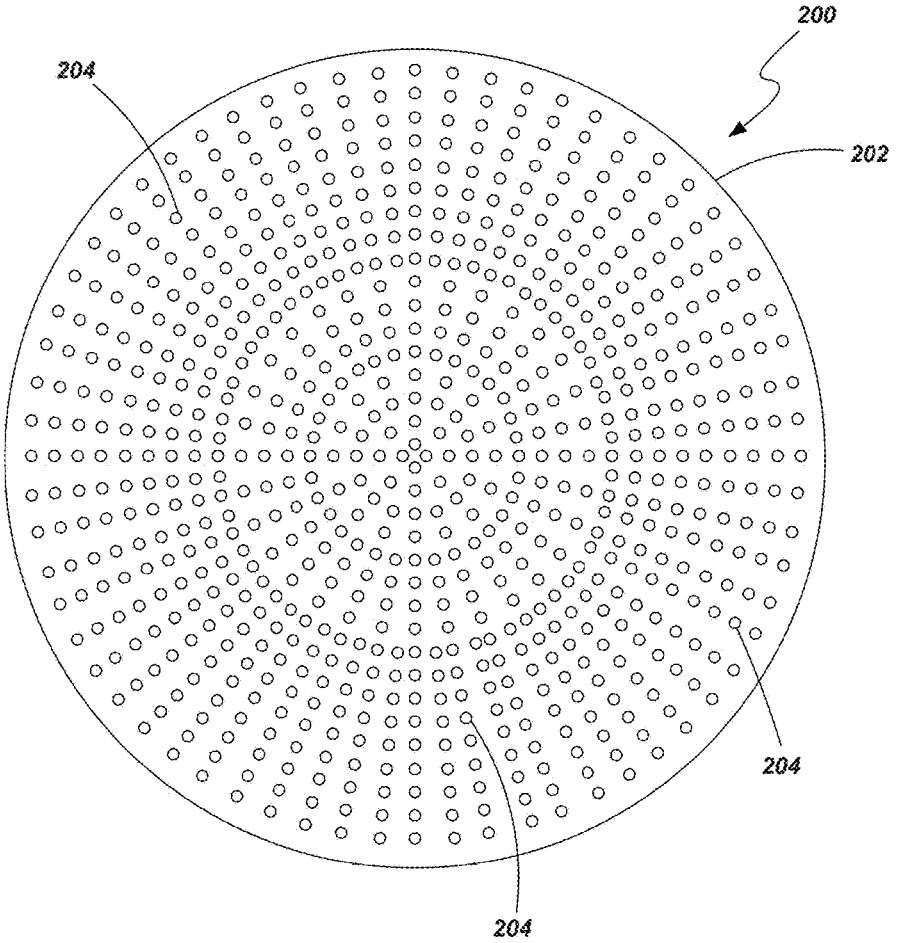
FIGS. 6A-6C show an end view, a cross sectional view, and an enlarged detail cross-sectional view, respectively, of a superabrasive element according to an embodiment of the present invention.
Figure 6B:
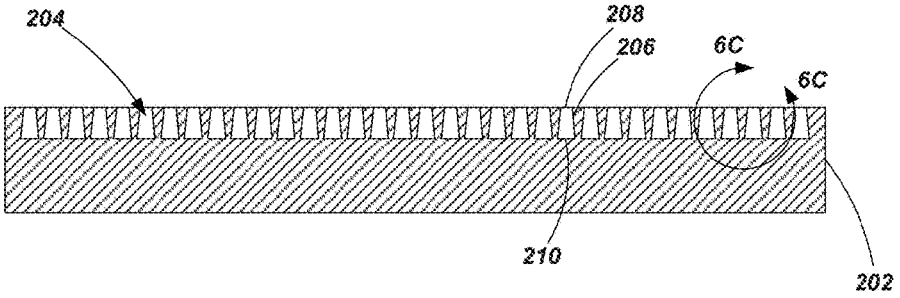

Referring now to FIGS. 6A and 6B, a superabrasive element 200 is shown in accordance with another embodiment of the present invention. The superabrasive element 200 may be formed in accordance with a number of processes, including formation from superabrasive particles, formation from a plurality of micro-structures or other discrete components, or formation from a combination of particles and components such as described above. The superabrasive element 200 may be substantially devoid of catalyst and/or infiltrant material, may include catalyst and/or infiltrant material within the interstitial areas of the superabrasive element, or may have one or more regions devoid of catalyst and/or infiltrant material and one or more regions having catalyst and/or infiltrant material within interstitial areas.

Figure 6C:
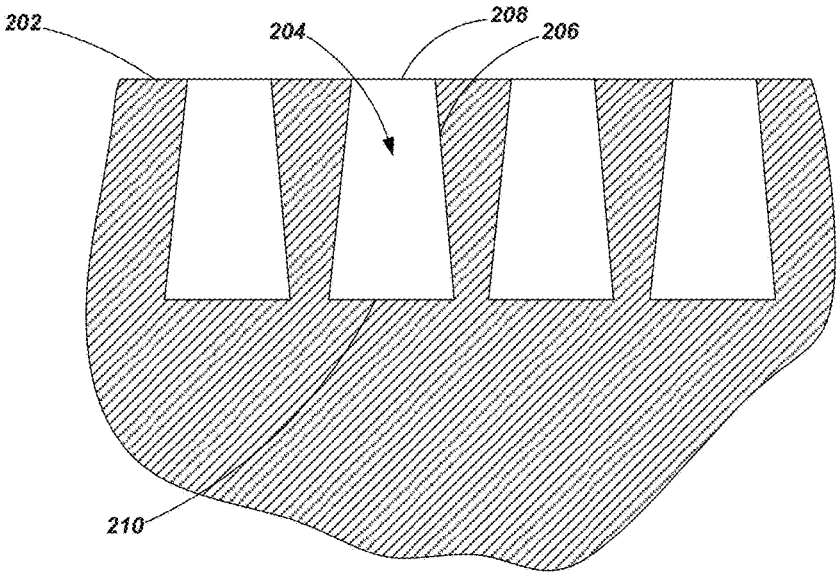

As shown in FIGS. 6A and 6B, the superabrasive element 200 may comprise a superabrasive table 202 having a plurality of holes 204 formed in a surface thereof. As seen in FIG. 6B, the holes 204 include blind holes, meaning that they have only one open end and do not pass through the entirety of the superabrasive table 202. As seen in FIG. 6C, the blind holes 204 include a sidewall 206 extending between the opening 208 and a floor or end surface 210. The sidewall 206 shown in FIGS. 6B and 6C are tapered such that the cross-sectional area of the hole 204 at the opening 208 is smaller than the cross-sectional area of the hole 204 at the floor or end surface 210. Such holes may be formed, for example, by micro-cutting techniques such as described above. In another embodiment, the taper may be reversed with the cross-sectional area of the hole 204 at the opening 208 being larger than the cross-sectional area of the hole 204 at the end surface 210 (such as may result from forming the holes using a laser). In other embodiments, the holes may exhibit no taper along the sidewall 206. In one example, the holes 204 may be spaced approximately 0.050 inch center to center, exhibit an nominal diameter of approximately 0.005 inch to approximately 0.010 inch and a nominal depth of approximately 0.025 inch to approximately 0.030 inch.

Figure 7A:
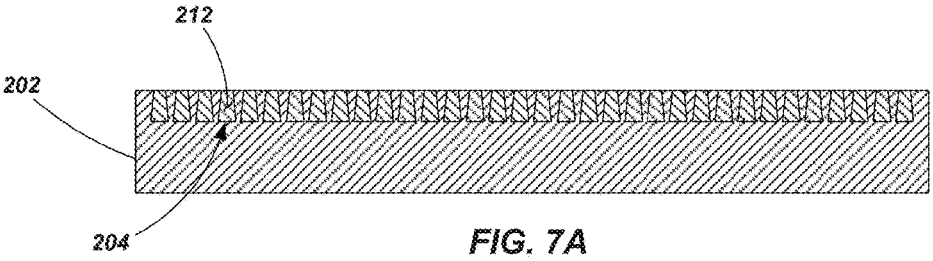
FIGS. 7A and 7B are cross-sectional views of superabrasive elements according to additional embodiments of the invention.

As shown in FIG. 7A, the holes 204 formed in the superabrasive table 202 may be filled with a material such as, for example, a high strength metal or metal alloy. For example, materials such as Stellite® alloys (e.g., cobalt-chromium alloys), titanium or titanium metal alloys (such as in powder form) may be used as a filler material 212. In another example, cobalt or other cobalt alloys (e.g., cobalt-tungsten alloys, cobalt-carbon alloys, cobalt-tungsten carbide alloys, or combinations thereof) may be used. In yet another embodiment, active metal brazing alloys may be used as a filler material 212. Such active braze alloys may include, for example, a brazing alloy (e.g., silver and copper) to which an amount of titanium is added. In the case of brazing and titanium alloys, such materials help to create a film of titanium carbide at the diamond/metal interface to help facilitate bonding. In the case of Stellite® materials, the cobalt component is also conducive to bonding or attachment to the diamond material during an HPHT process.

Figure 7B:
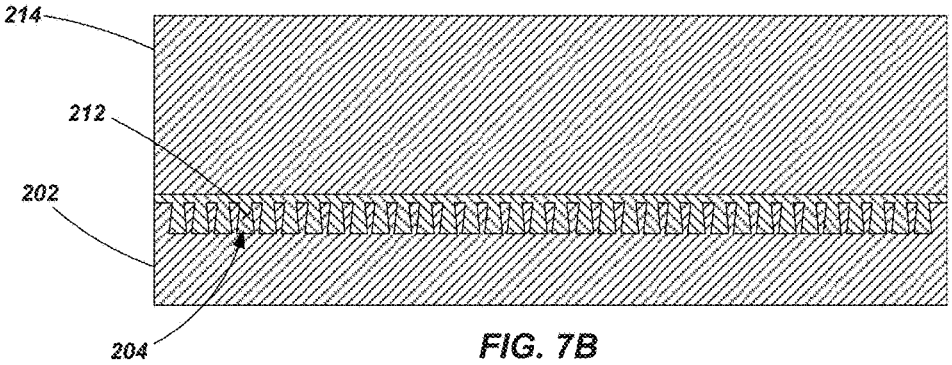

The tapered configuration of the holes 204 promote adhesion between the filler material and the superabrasive table 202. As seen in FIG. 7B, the plurality of holes 204 filled with a desired metal material may facilitate the bonding of the superabrasive table 202 with a substrate 214. For example, the superabrasive table 202 may be bonded to the substrate 214 by way of brazing, fusing, welding, infiltrating in a HPHT process or other appropriate joining processes.

In another embodiment, the holes 204 formed in a superabrasive table 202 may be coated with a material (e.g., such as by CVD of PVD processes discussed above) and the superabrasive table 202 may be bonded to a substrate during a subsequent HPHT process. In such an embodiment, a metal filler material may again be disposed in the holes 204. In another embodiment, the holes 204 may be coated with a desired material and a material from the substrate may be allowed to infiltrate the holes during subsequent attachment (e.g., during a second HPHT process) of the substrate 214 with the superabrasive table 202.

Figure 8:
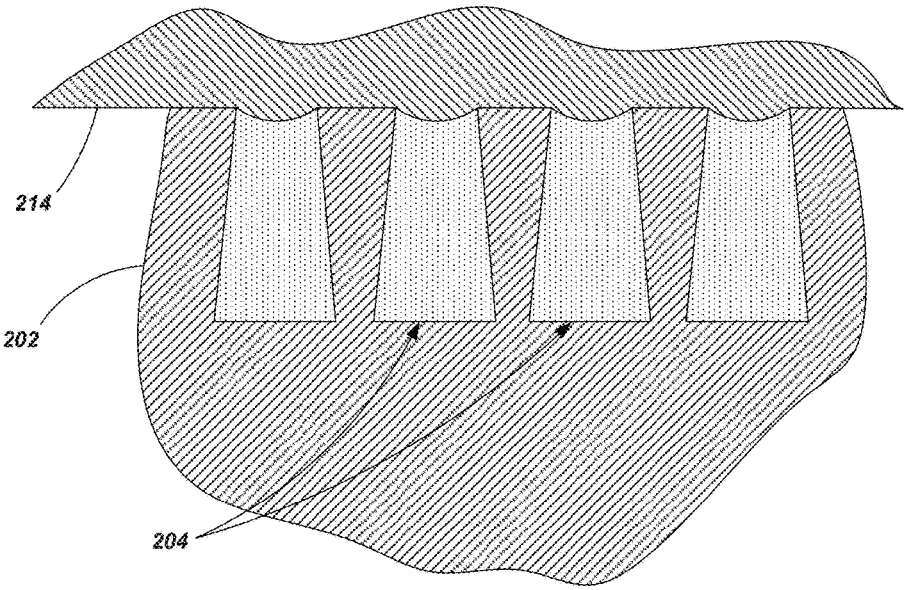
FIG. 8 is a cross-section view of a superabrasive element according an embodiment of the invention.
Figure 9:
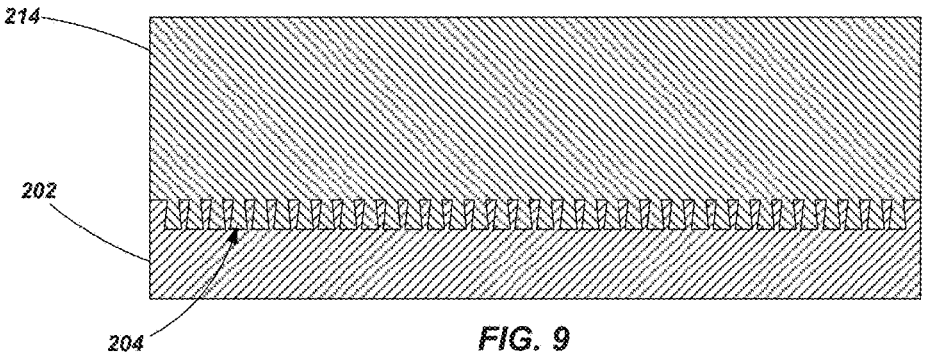
FIG. 9 is a cross-sectional view of a superabrasive element according to an embodiment of the invention.

As seen in FIG. 8, in one embodiment, the holes 204 may become filled with a material contained within the substrate 214 (e.g., cobalt, iron, nickel, tungsten, tungsten carbide) during the process of bonding the substrate with the superabrasive table 202. In some embodiments, the substrate 214 may deform such that it at least partially extends into the holes 204 such as depicted in FIG. 8. In other embodiments, the substrate 210 may deform during attachment to the superabrasive body such that it extends into and substantially completely fills the holes 204 such as depicted in FIG. 9.

Figure 10:
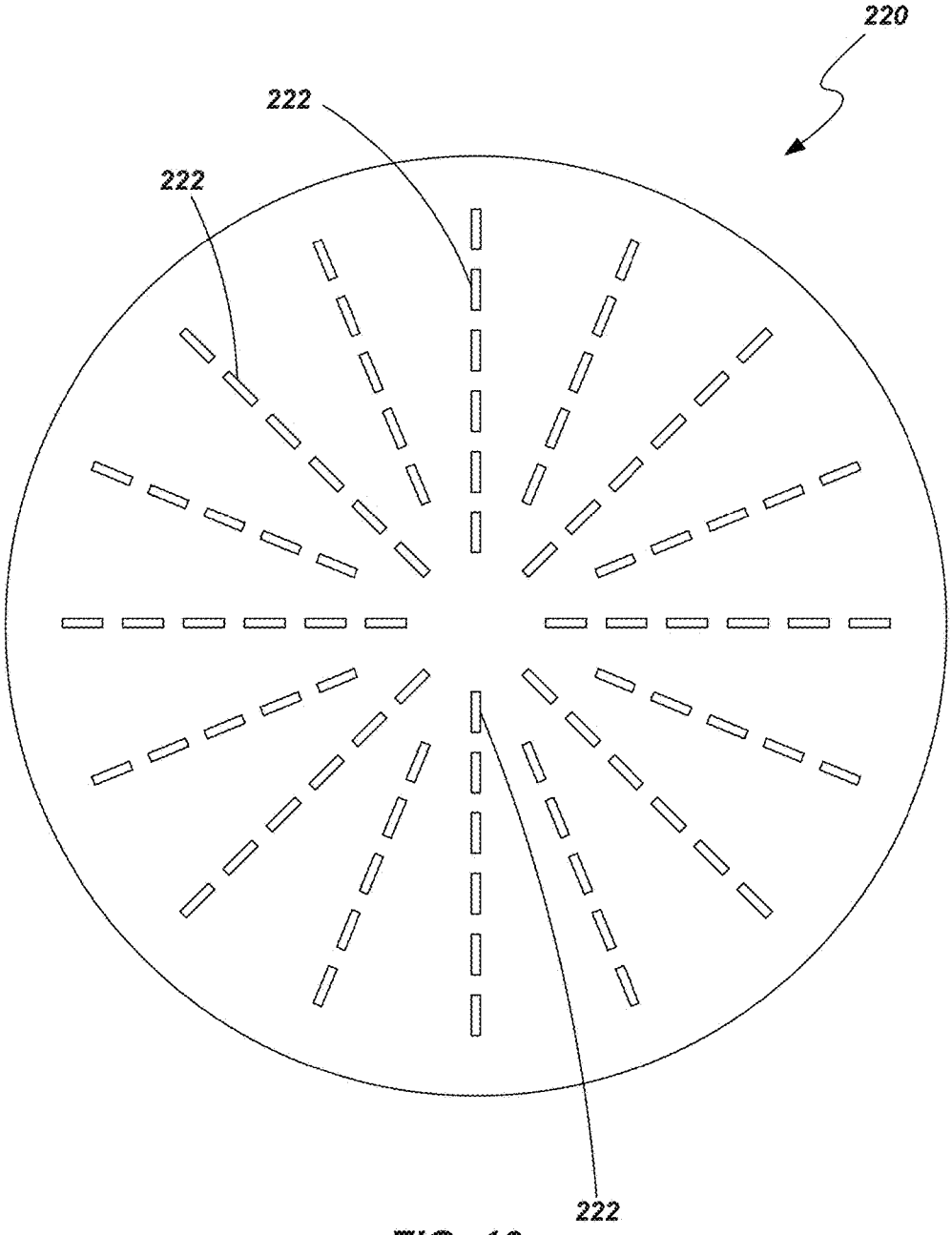
FIG. 10 is an end view of a superabrasive element according to an embodiment of the present invention.
Figure 11:
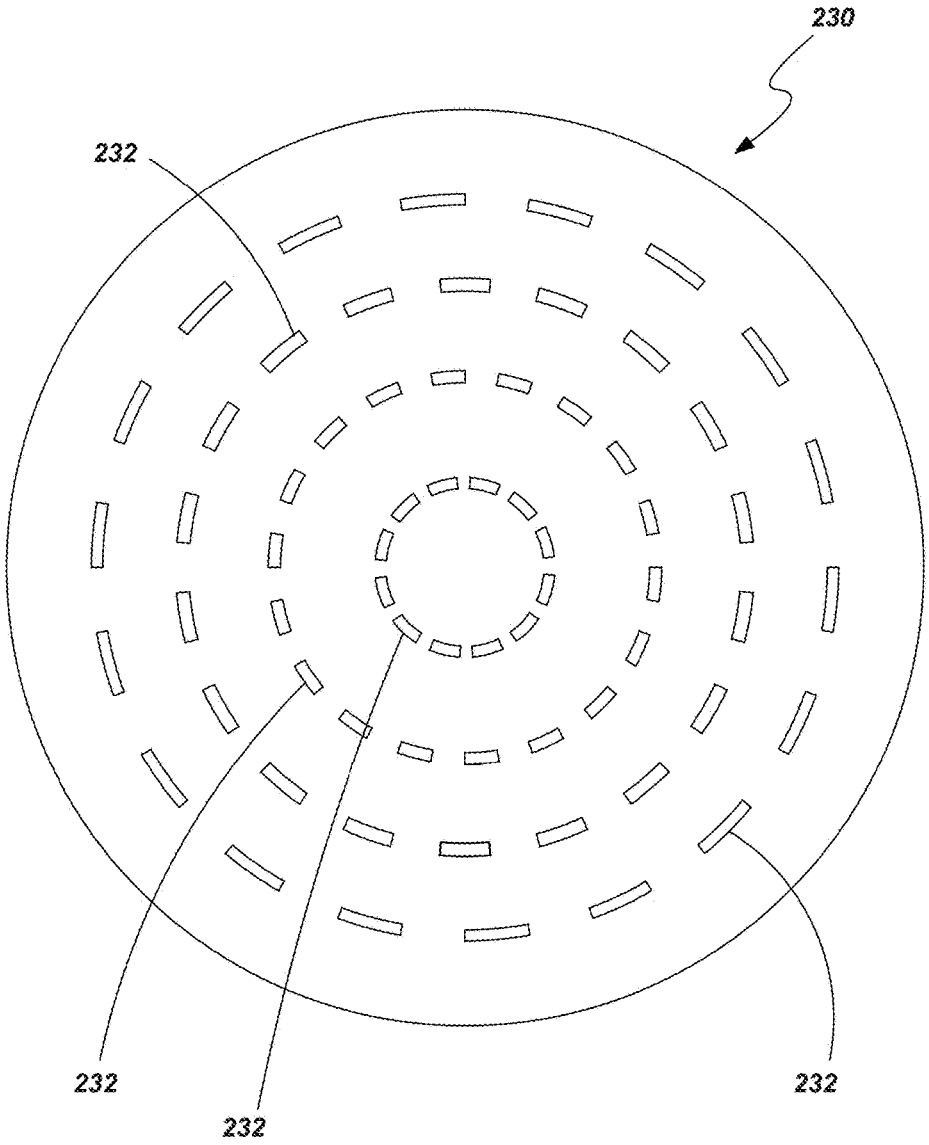
FIG. 11 is end view of a superabrasive element according to an embodiment of the present invention.

FIGS. 10 and 11 show additional embodiments of superabrasive elements 220 and 230 (each comprising a superabrasive table) wherein holes or other microfeatures are formed (e.g., micro-cut) into a surface of the element. For example, FIG. 10 shows a plurality of holes or slots 222 formed into the surface of the superabrasive element 220 wherein the slots 222 exhibit an elongated dimension extending in a substantially radial direction. The holes or slots 222 may be "blind" such as described above with respect to the embodiment illustrated in FIGS. 6A-6C. Additionally, the slots 222 may include sidewalls that are tapered or non-tapered such as described hereinabove with other embodiments. In the embodiment illustrated in FIG. 11, the superabrasive element 230 includes holes or slots 232 that are generally arcuate in geometry. In other words, the slots 232 include two radially spaced apart arcuate sidewalls. As with the embodiments described above, the slots may be "blind" holes, with sidewalls that are tapered (in either direction) or non-tapered. It is noted that in some embodiments, the use of slots (as opposed to circular holes) may provide beneficial stress management during manufacturing processes associated with attaching the superabrasive table to a substrate.

The holes of any of the described embodiments may be arranged in a desired pattern, including being formed in sets of holes or slots. For example, the sets may include a plurality of holes that are positioned in a generally circular (or radially repeating) pattern, an axially repeating pattern, or in both an axially and radially repeating patterns. Additionally, while the embodiments shown include a single "type" of hole (e.g., a circular hole, a linear slot or an arcuate slot), such types and geometries of holes may be combined and/or intermixed if desired.

Figure 12:
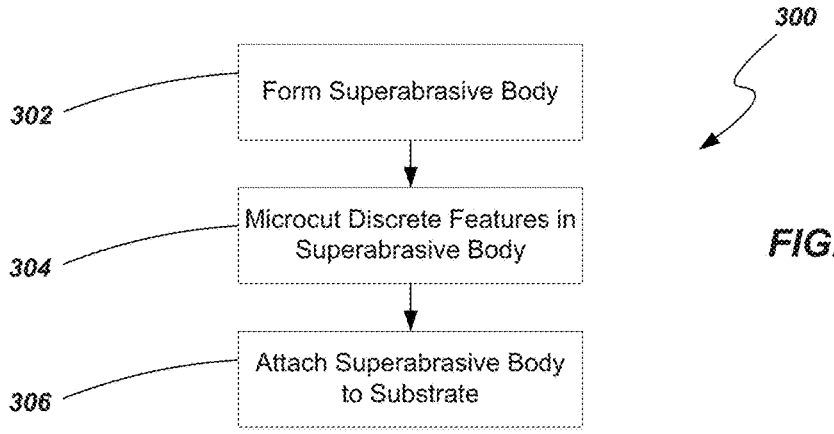
FIG. 12 is a flow chart showing a method of manufacture according to an embodiment of the invention.

Referring to FIG. 12 a method 300 of manufacturing a superabrasive element is illustrated. The method 300 includes forming a superabrasive body as indicated at 302. For example, a polycrystalline diamond table may be formed according to various techniques including those described hereinabove. The method further includes micro-cutting, or otherwise forming, discrete micro features in the superabrasive body as indicated at 304. Such features may include blind holes or slots such as described above. The superabrasive body is then attached to a substrate, the micro features being a vehicle to effect or enhance the attachment of the superabrasive body and substrate, as indicated at 306.

Figure 13:
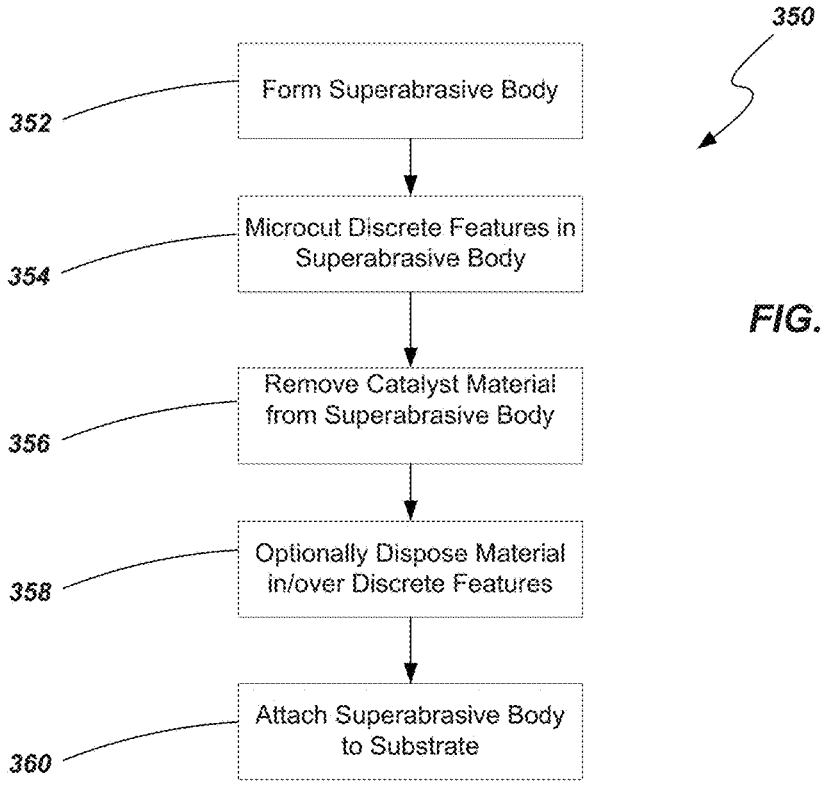
FIG. 13 is a flow chart showing a method of manufacture according to another embodiment of the invention.

Referring to FIG. 13 another method 350 of manufacturing a superabrasive element is illustrated. The method 350 includes forming a superabrasive body as indicated at 352. For example, a polycrystalline diamond table may be formed according to various techniques including those described hereinabove. Discrete microfeatures may then be formed in the superabrasive body as indicated at 354. Such features may include blind holes or slots such as described above. The method 350 further includes removing catalyst material from the superabrasive body as indicated at 356. For example, catalyst material may be removed from the interstitial spaces in a desired portion of, or the entirety of, the superabrasive body. While shown as occurring after the formation of discrete microstructures, the catalyst material removal may occur prior to formation of the discrete microstructures in some embodiments. A material may be disposed in or over at least a portion of the discrete microfeatures as indicated at 358. For example, in one embodiment, a filler material may disposed in the microfeatures. In another embodiment, the surfaces of the microfeatures may be at least partially coated such as described above. The superabrasive body is then attached to a substrate, the microfeatures being a vehicle to effect or enhance the attachment of the superabrasive body and substrate, as indicated at 360.

Figure 14:
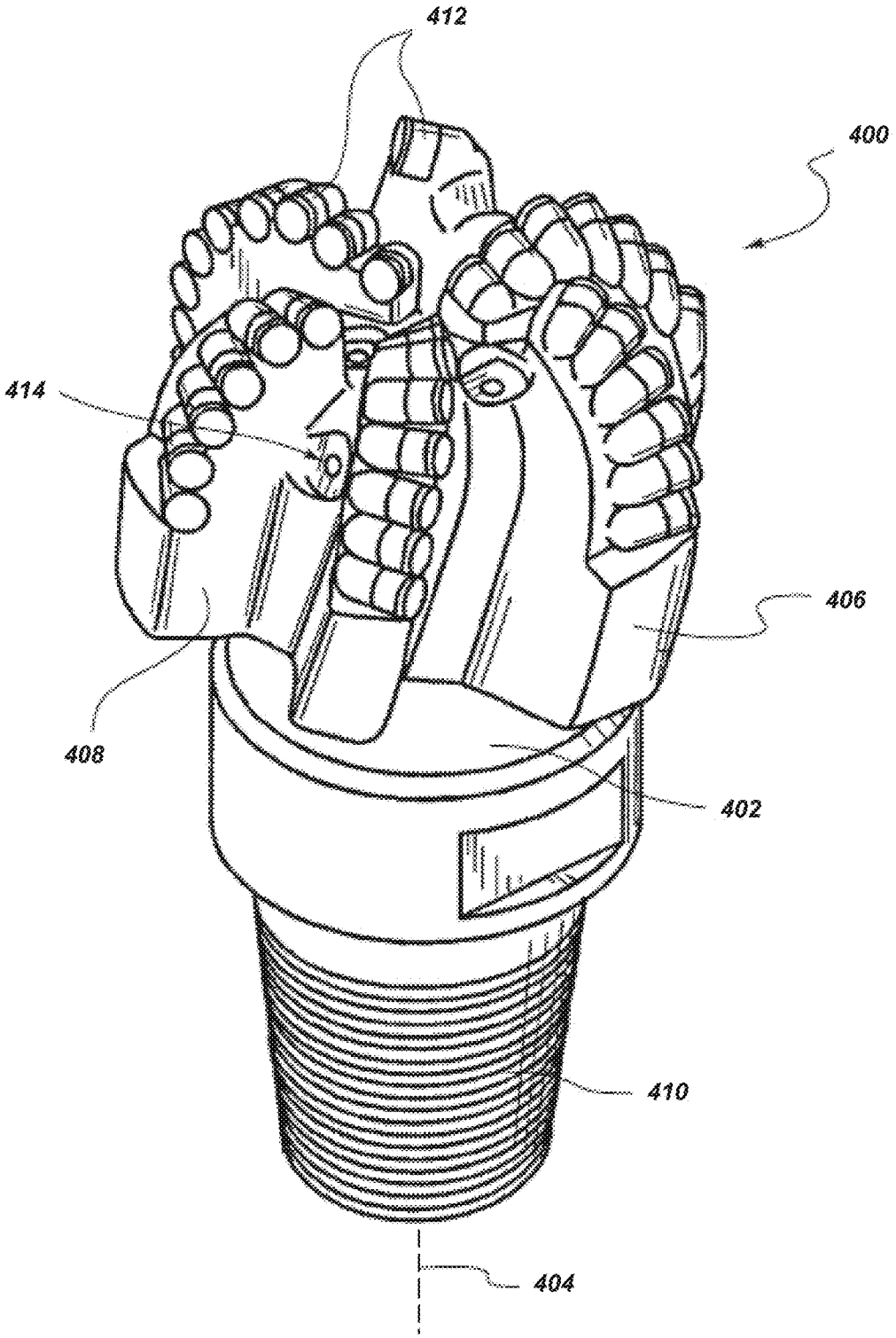
FIG. 14 is a perspective view of a rotary drill bit incorporating a cutting element according to an embodiment of the present invention.
Figure 15:
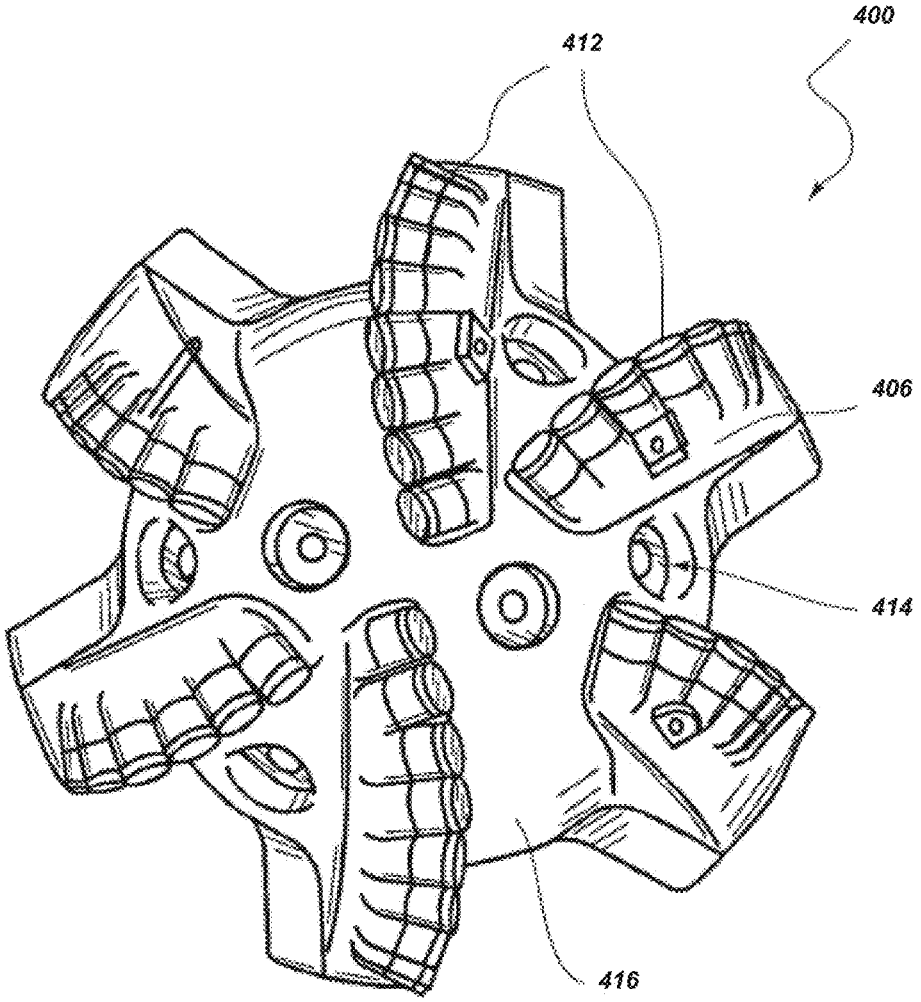
FIG. 15 is an end view of the drill bit shown in FIG. 14.

Referring to FIGS. 14 and 15, a rotary drill bit 400 is shown according to an embodiment of the invention. FIG. 402 is a perspective view of the rotary drill bit 400 and FIG. 15 is a top or end view of the rotary drill bit 400. The rotary drill bit 400 is configured for drilling into a formation, such as a subterranean formation, or any other material to be drilled. As illustrated in FIGS. 1 and 2, the rotary drill bit 400 may comprise a bit body 402 having a rotational axis 404, one or more bit blades 406 having rotational leading faces 408 (i.e., the face of the blade that "leads" the blade when the blade is rotated about the axis in an intended rotational direction), and a shank 410 which may include a threaded pin connection. A plurality of cutting elements 412 may be secured to bit body 402 of rotary drill bit 400 in a manner described in further detail below. The cutting elements 412 may include superabrasive elements such as described in various embodiments hereinabove. Slots, sometimes referred to as junk slots 416, may be defined between circumferentially adjacent blades 406 and be configured to enable material, such as rock debris and drilling fluid, to be conveyed away from the drill bit during a drilling operation. One or more nozzle cavities 414 may be defined in rotary drill bit 400 and configured to convey drilling fluid that is passed through a drill string and through the drill bit body 402. The rotary drill bit 400 may rotate about rotational axis 404 during operation of the drill bit, such as when engaged with a subterranean formation.

As noted above, the cutting elements 412 may be mounted to various suitable portions of the drill bit body 402. For example, the cutting elements 412 may be mounted to portions of bit blades 406 and configured to contact a formation during a drilling operation. The cutting elements 412 may have cutting surfaces and cutting edges adjacent to and/or extending from the leading faces 408 of the blades 406 such that the cutting surfaces and cutting edges contact a formation while the rotary drill bit 400 is rotated about its rotational axis 404 during a drilling operation. The nozzle cavities 414 defined in the drill bit 400 may communicate with an interior portion of the drill bit 400 (e.g., a plenum or other fluid flow path) such that drilling fluid may be conveyed from within the drill bit body, through the nozzle cavities 414, past the cutting elements 412 and various exterior portions of bit body 402. It should be understood that FIGS. 14 and 15 merely depict one example of a rotary drill bit employing cutting element assemblies of the present invention (e.g., a cutting element 412 formed from preformed micro-structures and/or having micro features formed therein), without limitation.

While the cutting elements 412 may be formed in accordance with the embodiments described above, it is also noted that the cutting elements 412 include superabrasive bodies without a substrate (such as also described above) that are directly attached to the drill bit. For example, such superabrasive bodies may be formed from discrete microstructures and/or may include holes or other micro-features formed therein to enhance the attachment of the superabrasive body to the drill bit.

One of ordinary skill in the art will appreciate that the discussed methods and structures could be used for varied applications as known in the art, without limitation. In addition, while certain embodiments and details have been included herein for purposes of illustrating aspects of the instant disclosure, it will be apparent to those skilled in the art that various changes in the systems, apparatuses, and methods disclosed herein may be made without departing from the scope of the instant disclosure, which is defined, at least in part, in the appended claims. Features and components described with regard to one embodiment may be combined with other embodiments, or with features and components of other embodiments, without limitation. The words "including" and "having," as used herein, including in the claims, shall have the same meaning as the word "comprising."

What is claimed is:

1. A method of forming a superabrasive element, the method comprising:

forming a first superabrasive body comprising a polycrystalline table in a high-pressure, high-temperature (HPHT) process, wherein forming the first superabrasive body includes sweeping a catalyst material into a plurality of diamond grains during the HPHT process, removing the catalyst material from interstitial spaces between bonded diamond grains subsequent to the HPHT process;

forming a plurality of discrete micro-structures from the superabrasive body;

forming a second superabrasive body from at least some of the plurality of discrete structures in an HPHT process;

forming a material coating on the at least some of the plurality of micro-structures subsequent to removing catalyst material and prior to forming the second superabrasive body.

2. The method according to claim 1, wherein forming a plurality of micro-structures includes forming at least one of a cylinder, a sphere, a polyhedron, a disc and a platelet.

3. The method according to claim 1, further comprising forming the plurality of micro-structures by an electric discharge machining (EDM) process.

4. The method according to claim 1, further comprising maintaining the at least some of the plurality of micro-structures free of catalyst material during the HPHT process associated with forming the second superabrasive body.

5. The method according to claim 4, further comprising attaching the second superabrasive body to a substrate.

6. The method according to claim 5, further comprising forming a plurality of micro-features in a surface of the second superabrasive body that is to be bonded to the substrate.

7. The method according to claim 6, wherein forming a plurality of micro-features includes forming a plurality of blind holes.

8. The method according to claim 7, further comprising disposing a material in the plurality of blind holes prior to attaching the superabrasive body to the substrate.

9. A superabrasive element comprising:

a superabrasive body comprising a plurality of pre-formed, superabrasive microstructures, the microstructures being bonded to one another through a high-pressure, high-temperature (HPHT) process;

wherein a plurality of interstitial spaces between the plurality of bonded microstructures include a catalyst material disposed therein and wherein a plurality of interstitial spaces within each of the microstructures are substantially devoid of any catalyst material;

wherein each of the plurality of microstructures has a material coating at least partially thereon.

10. A superabrasive element comprising:

a superabrasive body comprising a plurality of pre-formed, micro-cut, superabrasive microstructures, the microstructures being bonded to one another through a high-pressure, high-temperature (HPHT) process;

wherein a plurality of interstitial spaces between the plurality of bonded microstructures include a catalyst material disposed therein and wherein a plurality of interstitial spaces within each of the microstructures are substantially devoid of any catalyst material;

wherein the superabrasive element further comprises a plurality of diamond grains intermixed with and bonded to the plurality of plurality of microstructures.

11. The superabrasive element of claim 10, wherein the plurality of pre-formed, micro-cut, superabrasive microstructures, includes a plurality of pre-formed, laser-cut superabrasive microstructures are leached subsequent to being laser-cut.

12. The superabrasive element of claim 11, wherein the plurality of pre-formed, laser-cut, superabrasive microstructures.

13. The superabrasive element of claim 10, wherein the superabrasive body exhibits a coercivity of about 115 Oersteds or more.

14. The superabrasive element of claim 10, wherein the superabrasive body exhibits a specific magnetic saturation of about 15 Gauss·$cm^3$/grams or less.

15. A superabrasive element comprising:

a superabrasive body bonded to a preformed, superabrasive ring, wherein the superabrasive body includes a plurality of interstitial spaces having a catalyst material disposed therein, and wherein the superabrasive ring includes a plurality of interstitial spaces being substantially devoid of any catalyst material.

16. The superabrasive element of claim 15, wherein the superabrasive body comprises polycrystalline diamond, and wherein the preformed superabrasive ring comprises polycrystalline diamond.

17. The superabrasive element of claim 16, further comprising a material coating on the superabrasive ring.

18. A rotary drill bit for drilling a subterranean formation, the drill bit comprising:

a shank;

a bit body attached to the shank;

at least one superabrasive element coupled with the bit body, the at least one superabrasive element comprising:

a superabrasive body comprising a plurality of pre-formed, superabrasive microstructures, the microstructures being bonded to one another through a high-pressure, high-temperature (HPHT) process;

wherein a plurality of interstitial spaces between the plurality of bonded microstructures include a catalyst material disposed therein and wherein a plurality of interstitial spaces within each of the microstructures are substantially devoid of any catalyst material;

wherein each of the plurality of microstructures has a material coating at least partially thereon.

19. A rotary drill bit for drilling a subterranean formation, the drill bit comprising:

a shank;

a bit body attached to the shank;

at least one cutting element coupled with the bit body, the at least one cutting element comprising:

a superabrasive body bonded to a preformed, superabrasive ring, wherein the superabrasive body includes a plurality of interstitial spaces having a catalyst material disposed therein, and wherein the superabrasive ring includes a plurality of interstitial spaces being substantially devoid of any catalyst material.

20. A rotary drill bit for drilling a subterranean formation, the drill bit comprising:

a shank;

a bit body attached to the shank;

at least one superabrasive element coupled with the bit body, the at least one superabrasive element comprising a superabrasive body, the superabrasive body comprising a plurality of pre-formed, superabrasive microstructures, the microstructures being bonded to one another through a high-pressure, high-temperature (HPHT) process;

wherein a plurality of interstitial spaces between the plurality of bonded microstructures include a catalyst material disposed therein and wherein a plurality of interstitial spaces within each of the microstructures are substantially devoid of any catalyst material;

wherein the superabrasive element further comprises a plurality of diamond grains intermixed with and bonded to the plurality of plurality of microstructures.

* * * * *